US007857042B2

(12) United States Patent
Koopmans et al.

(10) Patent No.: US 7,857,042 B2
(45) Date of Patent: Dec. 28, 2010

(54) COILED TUBING INJECTOR HEAD

(75) Inventors: Sietse Jelle Koopmans, Meer (BE); Aldo Huizer, Hardinxveld-Giessendam (NL)

(73) Assignee: ASEP Holding B.V. (NL)

( * ) Notice: Subject to any disclaimer, the term of this patent is extended or adjusted under 35 U.S.C. 154(b) by 136 days.

(21) Appl. No.: 12/092,596

(22) PCT Filed: Mar. 30, 2006

(86) PCT No.: PCT/GB2006/001200

§ 371 (c)(1),
(2), (4) Date: May 5, 2008

(87) PCT Pub. No.: WO2006/103464

PCT Pub. Date: Oct. 5, 2006

(65) Prior Publication Data

US 2009/0250205 A1 Oct. 8, 2009

(30) Foreign Application Priority Data

Mar. 30, 2005 (GB) ..... 0506350.8
Mar. 30, 2005 (GB) ..... 0506351.6
Mar. 30, 2005 (GB) ..... 0506353.2

(51) Int. Cl.
*E21B 19/22* (2006.01)

(52) U.S. Cl. ..... 166/77.3

(58) Field of Classification Search ..... 166/384, 166/77.3; 226/173
See application file for complete search history.

(56) References Cited

U.S. PATENT DOCUMENTS 2,892,535 A 6/1959 Cullen et al.
4,142,596 A 3/1979 Dressel et al.
4,585,061 A 4/1986 Lyons, Jr. et al.
5,094,340 A * 3/1992 Avakov ..... 198/626.1
5,188,174 A 2/1993 Anderson, Jr. et al.
5,309,990 A 5/1994 Lance
5,853,118 A 12/1998 Avakov (Continued)

FOREIGN PATENT DOCUMENTS

EP 0486324 A2 5/1992

(Continued)

OTHER PUBLICATIONS

International Search Report dated Jul. 25, 2006 for International application No. PCT/GB2006/001200.

(Continued)

*Primary Examiner*—William P Neuder
(74) *Attorney, Agent, or Firm*—Carlson, Gaskey & Olds PC

(57) ABSTRACT

An improved coiled tubing injector head, comprising a plurality of powered chain loops, each having one practically straight side adjacent to the other chain loop(s) and biased against a tubing running in-between all the loops so as to grip the tubing and allow its transit into and out of a well. The chain loops are assembled from multifunctional links which both transmit drive and also form carriers for replaceable gripper blocks or are the carriers and gripper blocks combined, without need of a roller link chain or chains in addition to the multifunctional links. Three or more chain loops are provided, and the chain loops are driven by electric motors.

24 Claims, 8 Drawing Sheets

U.S. PATENT DOCUMENTS

| | | | | |
|---|---|---|---|---|
| 6,059,029 | A | 5/2000 | Goode | |
| 6,173,769 | B1 | 1/2001 | Goode | |
| 6,189,609 | B1 | 2/2001 | Shaaban et al. | |
| 6,332,501 | B1 * | 12/2001 | Gipson | 166/384 |
| 6,439,445 | B1 | 8/2002 | De Groot et al. | |
| 6,892,810 | B2 * | 5/2005 | Austbo et al. | 166/85.5 |
| 2004/0094306 | A1 | 5/2004 | Goode et al. | |
| 2004/0188100 | A1 | 9/2004 | Austbo et al. | |
| 2005/0224224 | A1 * | 10/2005 | Martin et al. | 166/77.3 |

FOREIGN PATENT DOCUMENTS

| | | | |
|---|---|---|---|
| EP | 0486324 | A3 | 5/1992 |

OTHER PUBLICATIONS

PCT International Preliminary Report on Patentability and Written Opinion issued Oct. 3, 2007 for International application No. PCT/GB2006/001200.

* cited by examiner

COILED TUBING INJECTOR HEAD

FIELD OF THE INVENTION

The invention relates generally to coiled tubing injectors for handling continuous or coiled tubing for insertion into and retrieval from a wellbore with intention to rectify or enhance the wellbore by hydraulic or mechanical means.

BACKGROUND TO THE INVENTION

Coiled tubing well intervention has been known in the oil production industry for many years. A great length, often exceeding 15,000 ft, of small diameter, typically 1.5 in, steel tubing is handled by coiling on a large reel, which explains the name of coiled tubing. The tubing reel is not appropriate as a winch drum, since the stresses involved in using it so would destroy the tubing. The accepted solution in the industry is to pull tubing from the reel, as it is required and pass the tubing around a curved guide arch, or 'gooseneck', so that it lies on a common vertical axis with the wellbore. To control passage of tubing into and out of the wellbore, a device called a coiled tubing injector head is temporarily mounted on the wellhead, beneath the guide arch. By use of the injector head, the tubing weight and payload is taken from approximately straight tubing at the wellhead, leaving only a small tension necessary for tidy coiling to the tubing reel. Coiled tubing is externally flush and is ideal for insertion through a pressure retaining seal, or stuffing box, into a live well, that is one with wellhead pressure that would eject fluids if not sealed. Typically a coiled tubing injector head needs to be able to lift, or pull, 40,000 lbs as tubing weight and payload when deep in the well. It also has to be able to push, or snub, 20,000 lbs to overcome stuffing box friction and wellhead pressure at the beginning and end of a trip. The coiling tension is controlled by a tubing reel drive system and remains approximately constant no matter if the injector head is running tubing into or out of the well, or if it is pulling or snubbing. The coiling tension is insignificant by comparison to tubing weight and payload carried by the tubing in the wellbore and is no danger to the integrity of the tubing. The tubing is typically run to a great depth in the well and then cycled repetitively over a shorter distance in order to place chemical treatments or to operate tools to rectify or enhance the wellbore. It is by careful control of the injector head that the coiled tubing operator manipulates the tubing depth and speed to perform the programmed tasks. In order that the injector head may manipulate the tubing, it has to grip the tubing and then, concurrently, move the means of gripping so as to move the tubing within the wellbore. Although other methods of achieving this aim are known, it is the solution of a plurality of chain loops which is relevant to the present invention.

Referring to FIGS. 1 and 2 of the accompanying drawings, the chain loops 1, which are closed or endless, are moved by driveshafts 3 via mounted sprockets 4, engaging with roller chain links 5, which form part of the total chain loop assembly. A length of each loop, adjacent to the other chain loop over an essentially straight and parallel length, is forced by some arrangement, for example the hydraulically motivated roller and link assembly 6, into vigourous frictional engagement with the tubing 2 so as to grip the tubing 2 firmly and prevent its slipping, uncontrolled, into the well. Numerous patents describe improvements to the structure and mechanism of such injector heads. U.S. Pat. No. 4,585,061 describes an improved load-bearing structure for such a machine and U.S. Pat. No. 5,188,174 an improved mechanism for forcing the chain lengths into tighter frictional engagement with the tubing, without the tubing becoming overstressed towards the bottom of the chain run. U.S. Pat. No. 5,188,174 also discloses improvements to the chain loop structure, as illustrated in FIG. 2, in which the pins linking the roller chain to the gripper blocks 7 are separately removable for each of the two roller chains 5 in the chain loop assembly. Furthermore, considerable prior art exists concerning only the details of the chain loops. U.S. Pat. No. 5,853,118 describes an improved surface geometry for the gripper block with which to contact the tubing, as illustrated as feature 9 in FIG. 3 of the accompanying drawings, where the tubing gripping surface is shaped to fit tubing of a range of sizes by means of a vee shaped groove. The vee shaped groove is in contrast to the semi-circular cusp-shaped groove 8, as illustrated in FIG. 2, which is seen in many designs. U.S. Pat. No. 5,853,118 also discloses a simplification to the chain assembly where each gripper block is secured to the roller chains 5 by the use of a single through pin per block 10 rather than by the traditional two pins per block. U.S. Pat. No. 6,173,769, describes a means to change quickly the pipe contact elements, or 'gripper blocks', without complete disassembly of the many chain components, as illustrated in FIG. 4 of the accompanying drawings. A carrier element 11 is provided between two roller chains 5 into which a gripper block 12, appropriate for the chosen pipe size, may be releasably installed.

All of these prior art proposals rely on roller chains 5 and matching sprocket forms 4 as the means of transmitting drive from the driving shafts 3 to the chain loop assemblies 1. Roller chain is inexpensive, readily available and very strong, yet its incorporation into the chain loop assemblies results in a weight and maintenance burden, since the prior art assemblies all comprise the many elements of two heavy duty roller chains, plus the gripper blocks which contact the tubing and sometimes their separable carriers 11 too.

Accordingly, it is among the objectives of embodiments of the present invention to provide an improved chain assembly that is at least as strong as conventional arrangements, but simpler, lighter and easier to maintain, whilst retaining the advantage of the ability to provide an embodiment where one might quickly replace the gripper blocks.

Prior art arrangements also rely on one or more hydraulic motors to move the chain loop assemblies 1. Historically, hydraulic motors have been a sensible choice, combining all the virtues of mechanical simplicity, high power density, high starting torque, safety in a hazardous environment and simple control systems. However, there also exist a number of disadvantages, namely the requirement for bulky drive hoses, mechanical inefficiency leading to heat dissipation problems and limited control flexibility, especially at low constant speeds.

There are numerous prior art proposals which seek to minimize the disadvantages of hydraulic drive, leading to solutions employing any combination of hydraulic motors from one high-speed motor as disclosed in U.S. Pat. No. 6,059,029 and embodied in the Hydra Rig 580 product to four low-speed motors as deployed in the supplanted Hydra Rig 480 product.

It is among the objectives of embodiments of the present invention to provide an improved coiled tubing injector head that resolves the limitations of traditional hydraulic drive systems.

The prior art proposals further rely on a single pair of opposing chain loops. The gripping force applied to two opposing chain loops is fundamentally disposed to squeeze the tubing out of shape, a most undesirable consequence. In recognition of this, considerable prior art exists concerning the form of the gripper blocks which contact the tubing. It has been considered by many practitioners that a suitable gripper block form, which supports the tubing at positions around its circumference, would be a palliative to the crushing force applied by the chain loading assemblies. For example U.S. Pat. No. 5,188,174 talks of gripper blocks as having "(an) arcuate recess of the front tubing contact surface (which) is normally the same radius as that of the tubing" and this is illustrated as groove 8 in FIG. 2 of the accompanying drawings. The limitation of such a semi-circular cusp-shaped block is better understood when it is realized that coiled tubing varies slightly in diameter, both from manufacture and in normal use. When coiled tubing is moved into and out of a well, it commonly contains significant internal pressure. The tubing's bending radii, both at the tubing reel and at the wellhead guide arch, are sufficient to yield the tubing material. The combination of internal pressure with the yielding caused by bending is such that the tubing grows slightly but permanently in diameter. To allow both for this and for manufacturing tolerance, a semi-circular cusp-shaped block must necessarily be made slightly larger than the nominal diameter of the tubing. Therefore in many cases it will only make a single but soft line-contact with the tubing and the block will provide no lateral support until the tubing is significantly deformed. U.S. Pat. No. 5,853,118 describes an alternate approach for the gripper block with which to contact the tubing, as illustrated in FIG. 3 of the accompanying drawings, where the tubing gripping surface is shaped to fit tubing of a range of sizes by means of a vee shaped groove 9. The four line-contacts thus produced by the pair of chains are more equally disposed around the tubing than the traditional two line-contacts from cusp-shaped blocks, but with the disadvantage that the line-contacts are hard, being against a straight edge and not softened by the co-operating curve of a cusp. U.S. Pat. No. 5,309,990 reveals a composite block in which an elastomeric layer is used to support each pair of a quadrant of cusp-shaped gripping elements. As illustrated in FIG. 5 of the accompanying drawings, the compliance of the elastomer 13, in conjunction with the geometry of the underlying metal support 14, allows the gripping elements 15 to adjust to slightly differing pipe diameters, so providing a good soft line-contact at four equally spaced positions around the tubing. However, the resulting chain loop assemblies are complicated and expensive to maintain, since the elastomeric elements are severely stressed and often suffer only a short service life.

Accordingly, it is among the objectives of embodiments of the aspects of the present invention to provide an improved coiled tubing injector head which, though based on the successful and tested concept of a plurality of chain loops, addresses the issue of preventing the crushing force, necessary to grip the pipe, from deforming the tubing.

SUMMARY OF THE INVENTION

According to the present invention there is provided a coiled tubing injector head comprising a plurality of powered chain loops, each loop having one substantially straight side adjacent to the other chain loop and arranged to be biased against a tubing running between the loops so as to grip the tubing and allow its transit into and out of a well, the chain loops comprising multifunctional links which both transmit drive and form carriers for gripper blocks.

This aspect of the invention provides a coiled tubing injector head in which the multifunctional links of the chain loops obviate the need to provide the conventional pair of roller chains with a gripper block mounted therebetween. This facilitates the provision of narrower chain loops, and facilitates provision of an injector head having three or four chain loops. This reduces the deformation of the coiled tubing on passing through the injector head, increasing tubing life and reducing the likelihood of tubing failure. It is also possible to apply a greater gripping force to the tubing between three or four driven chain loops, such that the height of the injector head may be reduced. In other embodiments one or more of the chain loops may not be driven.

One or more chain loops may be driven by one or more electric motors. The motors may be permanent magnet electric motors. Such motors are suitable for use in hazardous areas where flammable gases or liquids may be present as the absence of sliding or rotating contacts reduces the sparking hazard. Such motors are also relatively compact for their torque capability and, if adequate cooling is provided, are capable of providing full torque from rest.

Shaft or pins may couple adjacent links. The shafts may be held to resist one or both of rotation and longitudinal movement. The shafts may be retained by members which engage ends of the shafts. In one embodiment the shafts are retained relative to the links by locking plates fixed to the links by releasable fixings, such as screws. The shafts may provide mounting for rollers, which may take the form of needle roller assemblies. The rollers may be adapted to engage with a drive member, such as a sprocket. The form of the rollers and the sprocket teeth may coincide, to provide a relatively large area contact between the rollers and sprocket. The links may include a lubrication arrangement. In one embodiment the links include lubrication distribution channels, which may be adapted to facilitate passage of lubricating oil or grease from access points, such as grease nipples, to the interface between the shafts and the rollers.

Each link may comprise side members and a cross member extending therebetween, and one or more shafts extending between the side members. One or more rollers may be mounted on the shafts between the side members. The gripper blocks may be provided on the cross members. The gripper blocks may be formed integrally or otherwise non-releasably fixed to the cross members, though in certain embodiments the gripper blocks may be releasably mounted to the cross members, allowing replacement or interchange of gripper blocks to accommodate wear or damage or to allow an injector head to handle a different tubing diameter.

Adjacent chain loops may be adapted to interlock, typically at the straight side, to ensure that the loops travel at the same speed. This may be achieved by providing two different link forms, and by offsetting one loop relative to an adjacent loop it is possible to lock the loops together.

According to another aspect of the present invention there is provided a coiled tubing injection head comprising a plurality of powered chain loops, each loop having one substantially straight side adjacent to the other chain loop and arranged to be biased against a tubing running between the loops so as to grip the tubing and allow its transit into and out of a well, wherein the chain loops are powered by one or more electric motors.

According to a further aspect of the present invention there is provided a coiled tubing injector head comprising at least three chain loops, at least some of which chain loops are powered, each chain loop having one substantially straight side adjacent to the other chain loops and being adapted to be biased against a tubing running between the loops so as to grip the tubing and allow its transit into and out of a well.

BRIEF DESCRIPTION OF THE DRAWINGS

These and other aspects of the present invention will now be described by way of example, with reference to the accompanying drawings, in which.

DESCRIPTION OF THE PREFERRED EMBODIMENT

The present embodiments as illustrated and described herein represent currently the best ways known to the applicant of putting the invention into practice, but they are not the only ways by which the invention could be achieved. Thus, the various embodiments are illustrated and will be described only by way of example.

Figure 1:
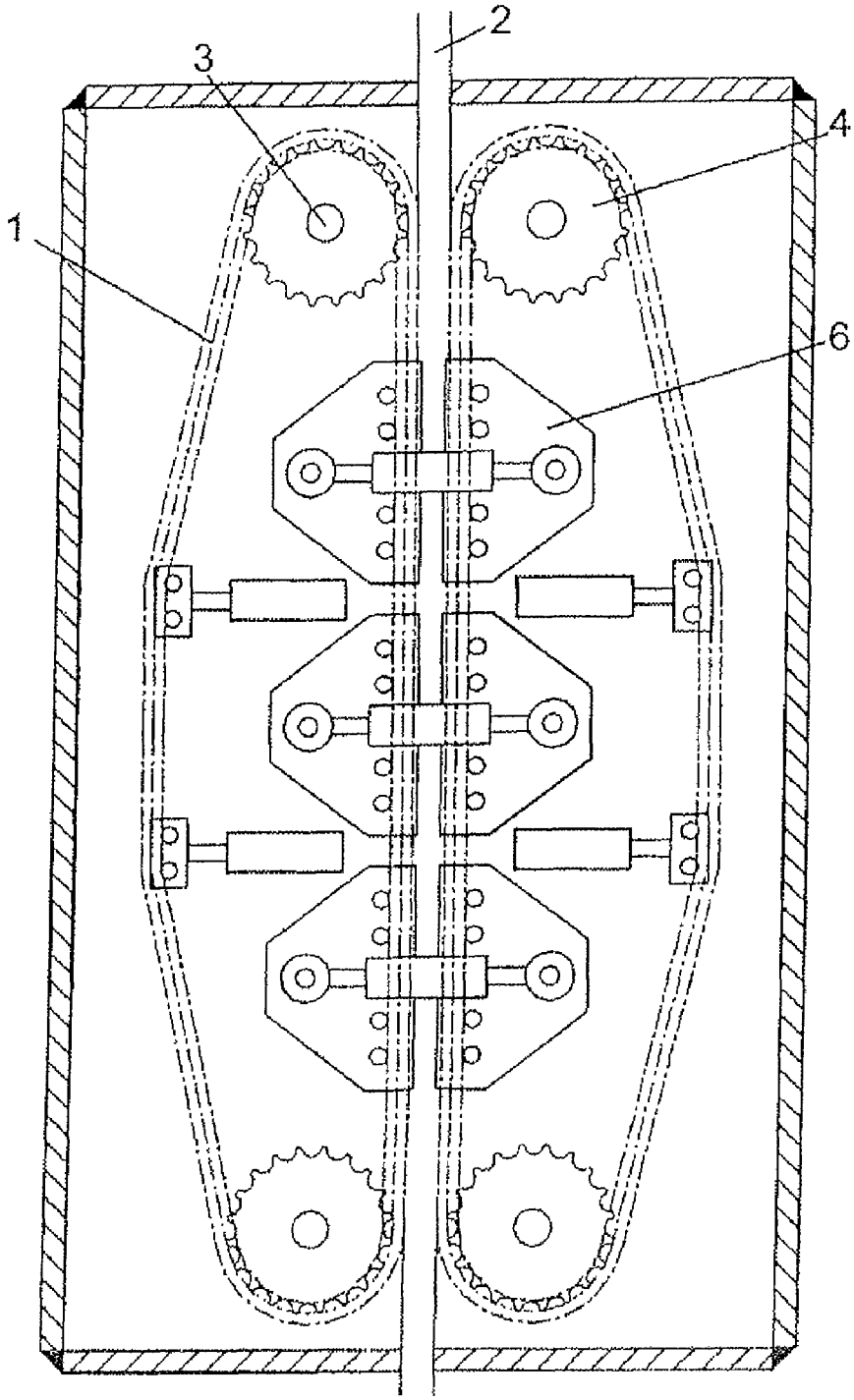
Fig. 1 PRIOR ART
FIG. 1 shows a conventional coiled tubing injector head.
Figure 2:
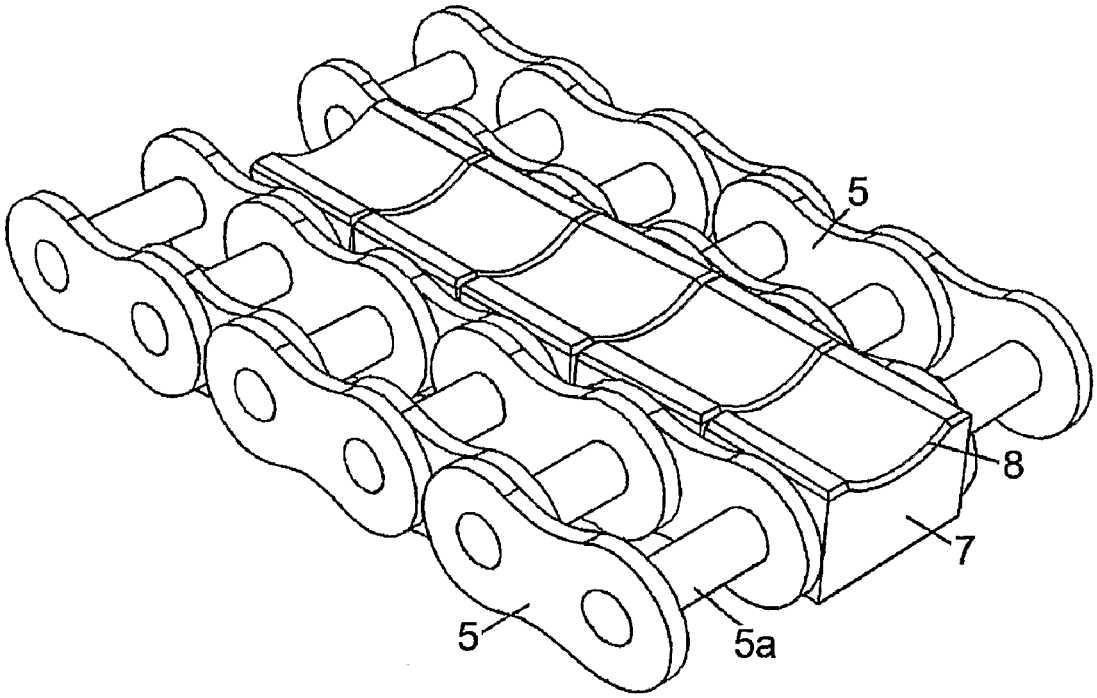
Fig. 2 PRIOR ART
FIG. 2 shows the use of two roller chains assembled in conjunction with gripper blocks shaped to fit a particular tubing size.
Figure 3:
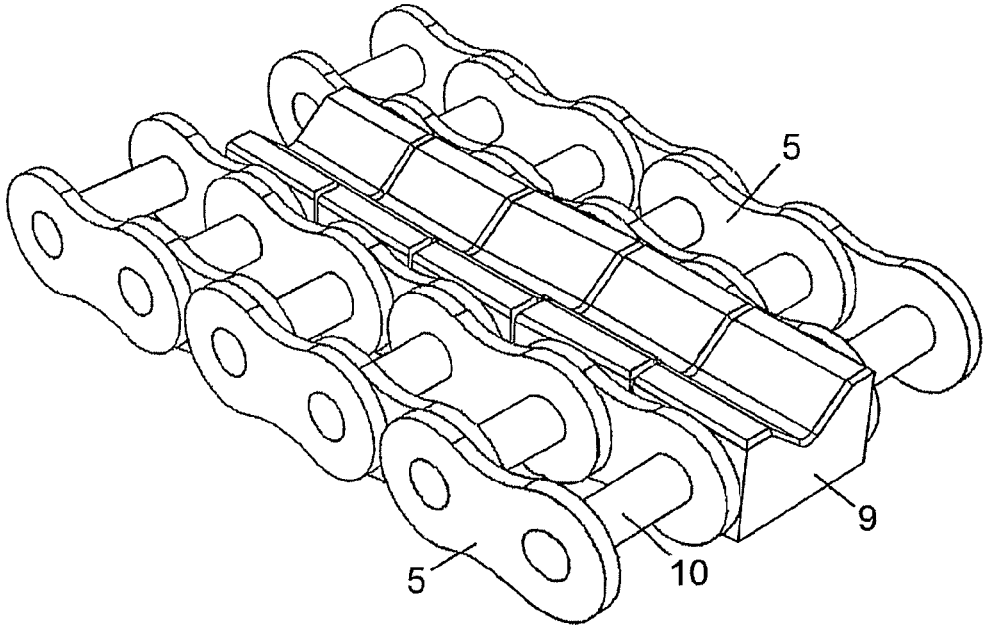
Fig. 3 PRIOR ART
FIG. 3 shows the use of two roller chains assembled in conjunction with gripper blocks shaped to fit tubing of a range of sizes by means of a vee shaped groove.
Figure 4:
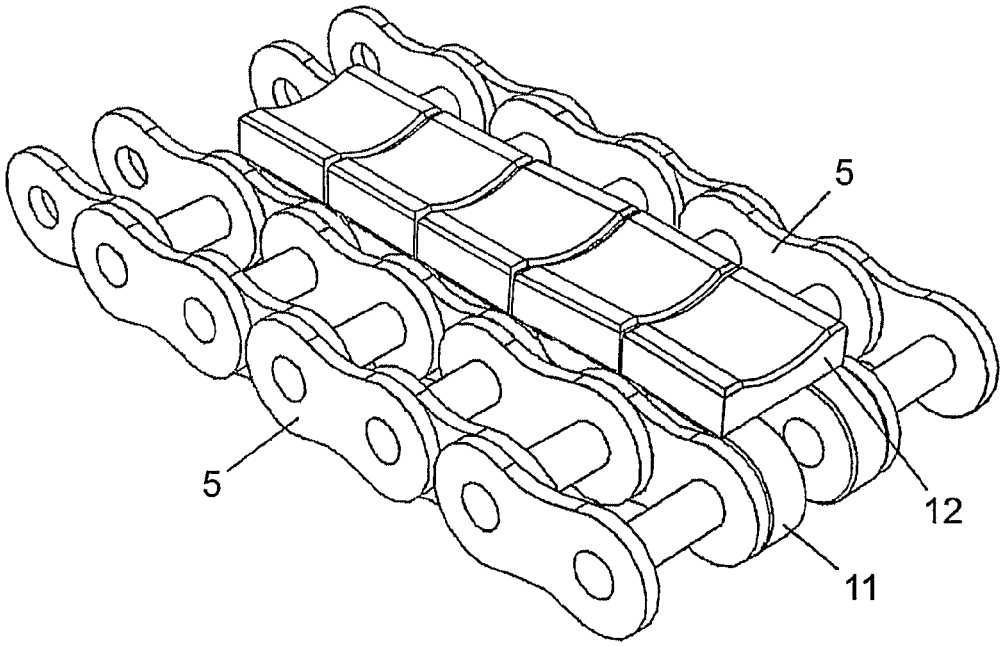
Fig. 4 PRIOR ART
FIG. 4 shows the use of two roller chains assembled in conjunction with gripper block carriers, intended for releasable connection to gripper blocks proper, the blocks being shaped to fit a particular tubing size.
Figure 5:
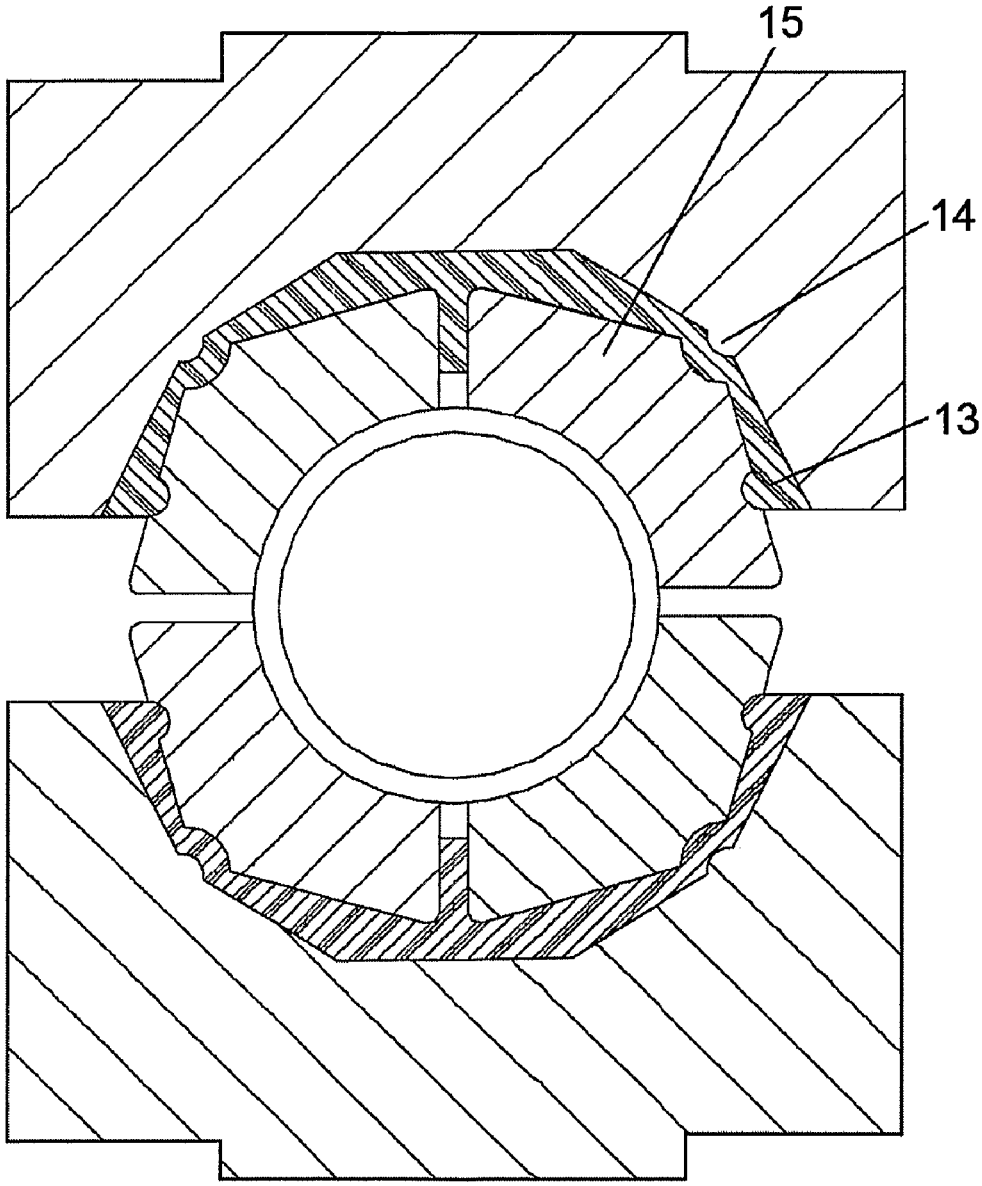
Fig. 5 PRIOR ART
FIG. 5 shows the use of gripper blocks with a composite structure combining a compliant elastomeric element.

The invention relates to an improved coiled tubing injector head of the general type illustrated in FIG. 1 and comprising a plurality of endless or closed chain loops 1, each having one practically straight side adjacent to the other chain loops and biased against a tubing 2 running between all loops. The biasing arrangement, for example a hydraulically linked roller assembly 6, acts so as to grip the tubing and allow its transit into and out of a well by motion of the chains.

Figure 6:
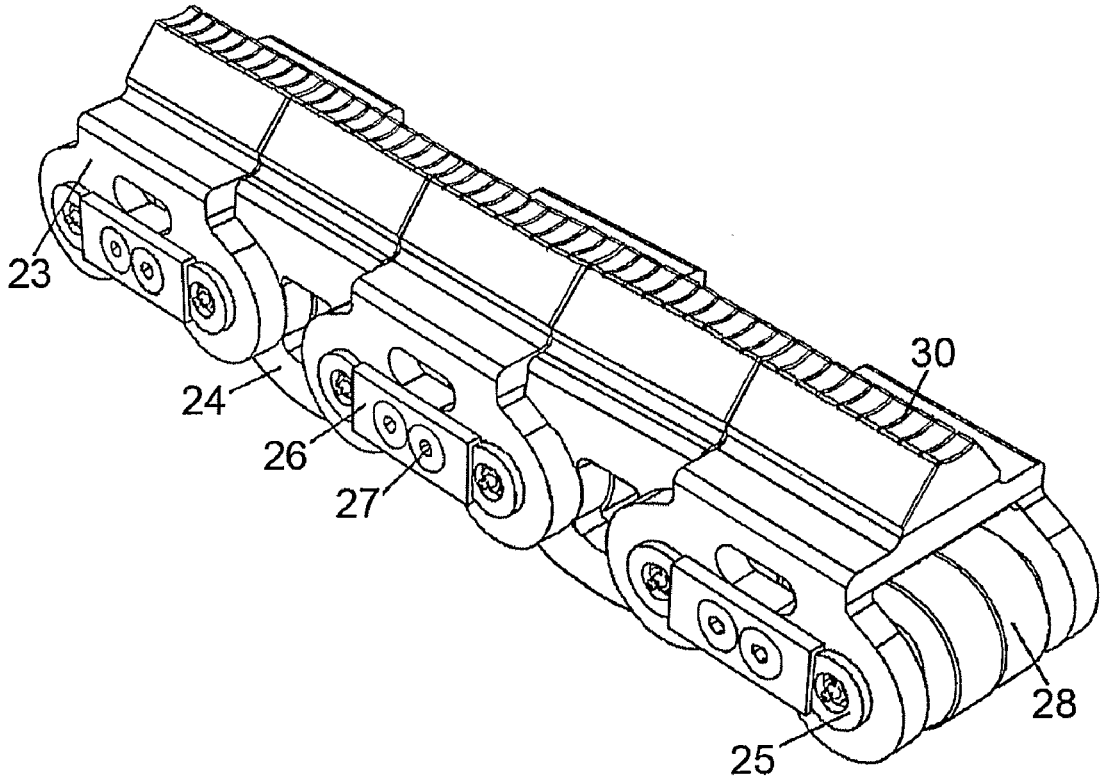
FIG. 6 shows one embodiment of an aspect of the present invention in isometric view, wherein the chain links form gripper blocks suited to one size of tubing.

In the first embodiment of the invention, as illustrated in FIG. 6, the chain of the loop is composed of two link types 23, 24 cooperatively configured to form a chain structure when assembled in alternating order by means of shafts 25. Locking plates 26 retained by screws 27 laterally restrain the shafts 25 and also prevent their rotation. To facilitate the motion of the chain over the surface of the biasing arrangement, needle roller assemblies 28, known in the industry as cam rollers, are coaxially mounted on every shaft 25. Each link type 23, 24 features an arcuate tubing gripping surface 30 closely contoured to the diameter of the coiled tubing for which it is suited. The several sizes of coiled tubing available thus require an equal number of appropriately contoured chain link designs. A variance of the first embodiment is that each link type features a tubing gripping surface shaped to fit tubing of a range of sizes by means of a substantially vee shaped groove.

Figure 7:
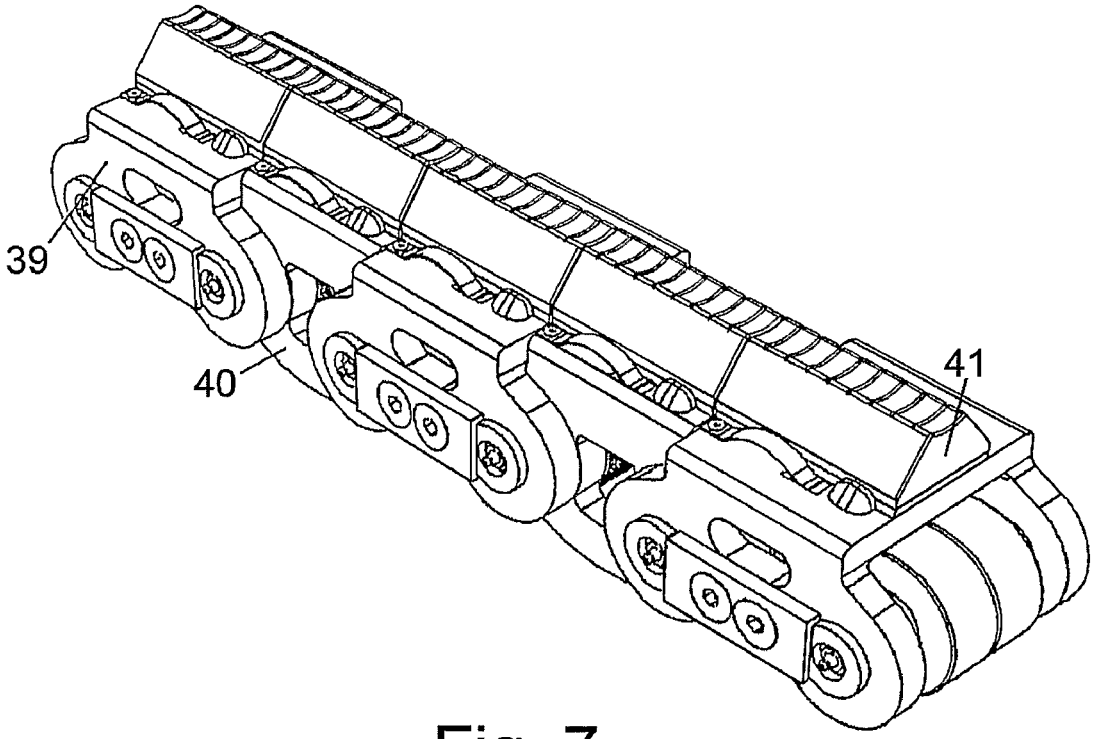
FIG. 7 shows an alternate embodiment of an aspect of the present invention in isometric view, wherein the chain links form carriers for separable gripper blocks, which gripper blocks are suited to one size of tubing.

An alternate embodiment is seen in FIG. 7 of the drawings, wherein the chain links 39, 40 are differently configured, so as to form carriers for separable gripper blocks 41. Thus, gripper blocks that are suited to one size of tubing may be conveniently exchanged for those suited to another size, without the material expense to change the complete chain assemblies. The form of the cooperation between the carrier links and the gripper is an exceptionally robust round peg and socket retained by a quarter-turn bayonet locking mechanism.

Figure 8:
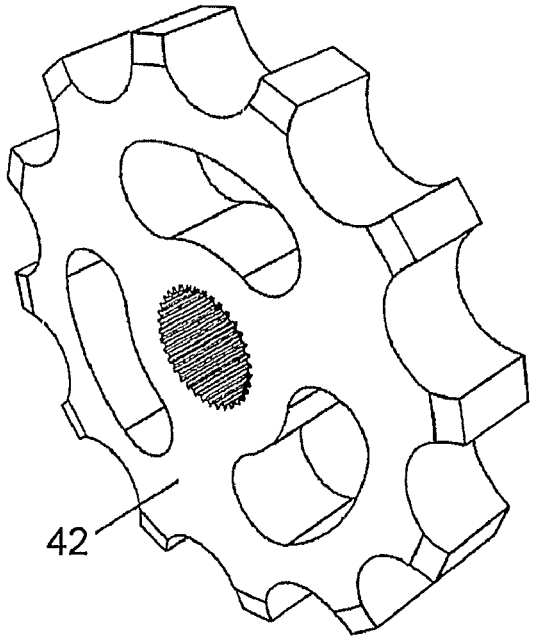
FIG. 8 shows a sprocket form suitable for engaging with the cam roller elements of the chain links of FIGS. 6 and 7.

It will be seen that the complete chain assembly in both disclosed embodiments has no roller chain elements and cannot engage with a standard sprocket form. The solution expressed in the preferred embodiments is to employ the cam rollers to perform the function of the rollers in a roller chain. Referring to FIG. 8 of the drawings, a special sprocket form 42, suitable for the diameter and spacing of the cam rollers, is utilized.

Figure 9:
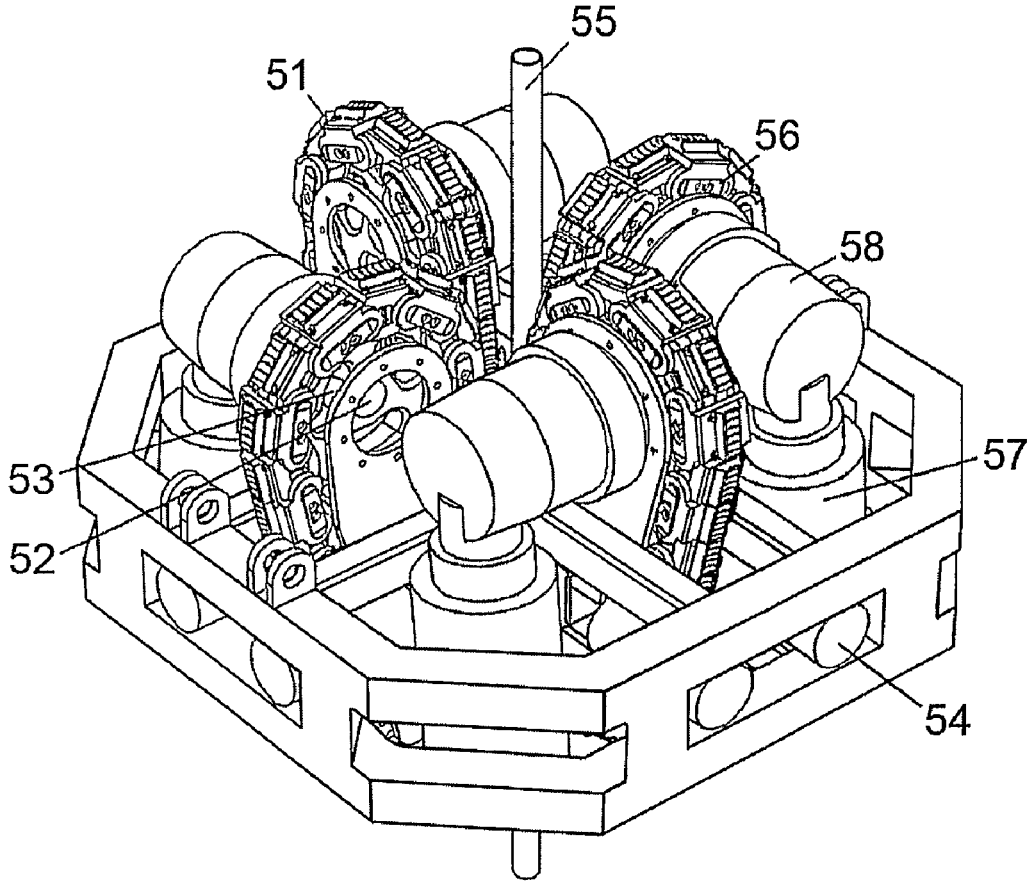
FIG. 9 shows an embodiment of an aspect of the present invention, wherein four chain loops are each driven by an electric motor acting through a gearbox assembly.

In the preferred embodiments of the present invention the injector head features, as illustrated in FIG. 9 of the drawings, four chain loops. Each loop 51 has one practically straight side adjacent to the other chain loops and is biased against the tubing 55 running between all the loops 51. In this embodiment, the chain loops 51 are set out as two opposing pairs and spaced equally around the tubing 55. Furthermore, the chain loops 51 are mounted on identical tractor assemblies 56, which are pushed toward the tubing by cylinder pairs 54, so as to grip the tubing and allow its transit into and out of a well by motion of the chains. Chain motion is achieved by permanent magnet synchronous motors 57, in combination with reduction gearboxes and brake modules 58, drive shafts 52 and sprockets 53. Withdrawal of all the cylinders withdraws the tractor assemblies from the machine centerline, so allowing a large diameter object, for example an oil-well tool assembly, to pass through the injector head.

Figure 10:
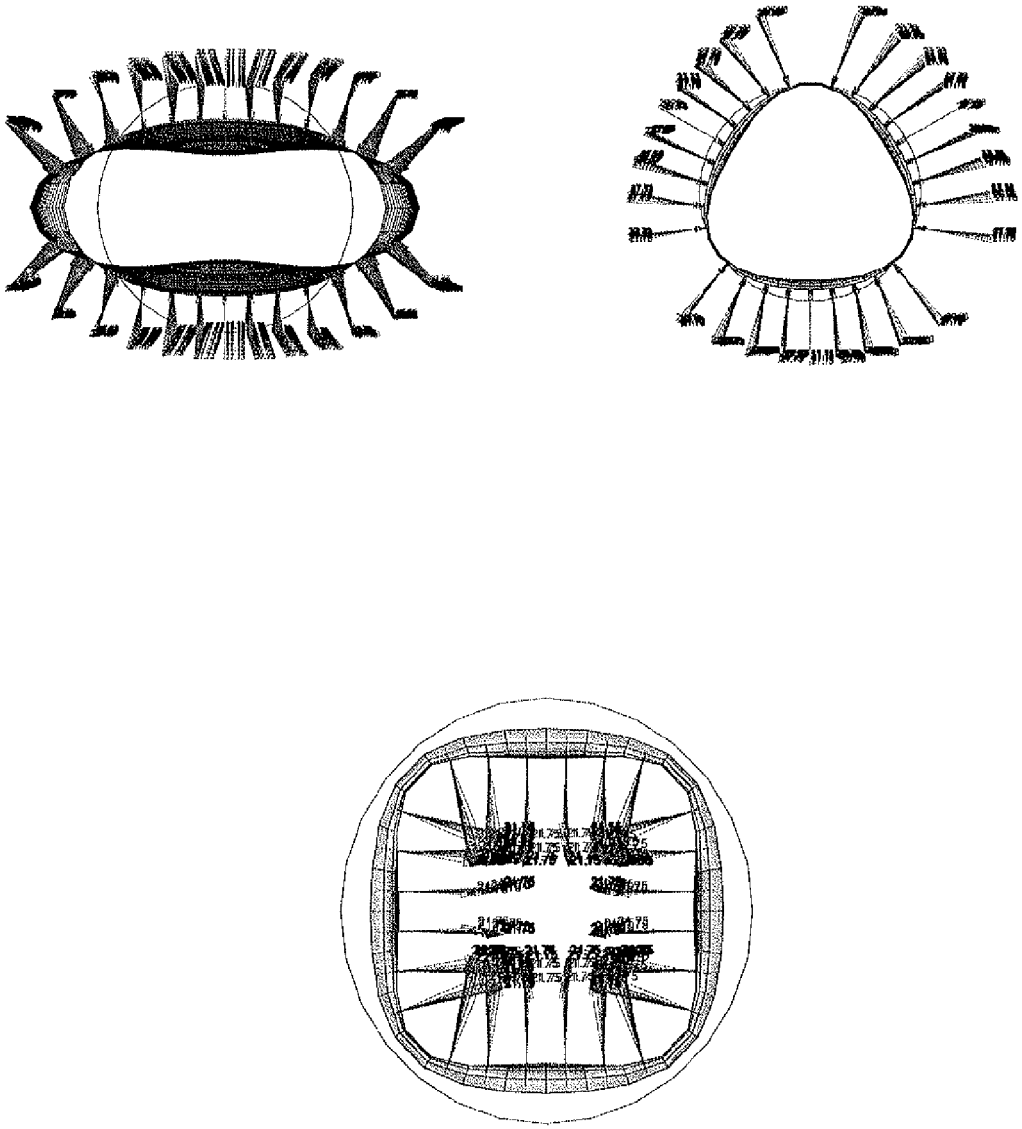
FIG. 10 shows how deformation of the tubing is ameliorated by using a number of chain loops greater than two and further indicates that four loops offer a significant improvement over three.

With reference to FIG. 10, it will be seen that deformation of the tubing is significantly ameliorated by using three chain loops rather than two, and a still greater improvement is obtained by using four chain loops, as illustrated in FIG. 9.

It should be noted that in other embodiments and in order to achieve the aim of reducing distress to the tubing 55, gripping chain loops may be used that are not powered. Such an embodiment might contain one diametrically opposed pair of chains which are driven, plus another pair, set perpendicularly, that are not driven but maintain the same gripping force in order to promote an even stress on the tubing circumference. Such an embodiment provides an improvement in stress distribution, but is not ideal. The purpose of gripping the tubing is to transfer motion from a drive system to the tubing and thus control the tubing in the wellbore. Undriven chain loops do not contribute to the friction force available to transmit motion and thus the resulting injector head design would need twice the gripping length as a fully driven injector head in accordance with the preferred embodiment in order control the same tubing weight and payload.

The invention claimed is:

1. A coiled tubing injector head comprising a plurality of powered chain loops, each loop having a substantially straight portion adjacent a substantially straight portion of another chain loop and arranged to be biased against tubing running between the loops so as to grip the tubing and allow its transit into and out of a well, the chain loops comprising multifunctional links adapted to both transmit drive from a sprocket and form gripper blocks.

2. The injector head of claim 1 in which the gripper blocks define a tubing-gripping surface closely contoured to the diameter of tubing to be injected.

3. The injector head of claim 1 in which the multifunctional links comprise carriers for replaceable gripper blocks.

4. The injector head of claim 1, wherein at least three chain loops are provided.

5. The injector head of claim 1, wherein at least three driven chain loops are provided.

6. The injector head of claim 1, wherein four chain loops are provided.

7. The injector head of claim 1, wherein four driven chain loops are provided.

8. The injector head of claim 1, wherein each chain loop is driven by an electric motor.

9. The injector head of claim 8, wherein the electric motors are permanent magnet electric motors.

10. The injector head of claim 1, wherein shafts couple adjacent links.

11. The injector head of claim 10, wherein the shafts provide mounting for rollers.

12. The injector head of claim 11, wherein the rollers take the form of needle roller assemblies.

13. The injector head of claim 11, wherein the rollers are adapted to engage with a drive member.

14. The injector head of claim 1, wherein the links include a lubrication arrangement.

15. The injector head of claim 1, wherein each link comprises side members and a cross member extending therebetween, and at least one shaft extending between the side members.

16. The injector head of claim 15, wherein at least one roller is mounted on the shaft between the side members.

17. The injector head of claim 15, wherein the gripper blocks are provided on the cross members.

18. The injector head of claim 1, wherein straight portions of adjacent chain loops are adapted to interlock.

19. The injector head of claim 1, wherein two different link forms are provided, and adjacent chain loops are offset to interlock the loops.

20. The coiled tubing injector head of claim 1, wherein each chain loop is mounted on an independent tractor assembly, such that the tractor assemblies may be moved away from an injector head centerline, so allowing a larger diameter object to pass through the injector head.

21. The coiled tubing injector head of claim 1, wherein the injector head has no roller chain elements.

22. A coiled tubing injector head comprising at least three chain loops, at least some of the chain loops being powered, each loop having one substantially straight portion adjacent a substantially straight portion of another chain loop and adapted to be biased against a tubing running between the loops so as to grip the tubing and allow its transit into and out of a well, wherein each loop comprises multifunctional links adapted to both transmit drive from a sprocket and form gripper blocks.

23. The coiled tubing injector head of claim 22 comprising at least three powered chain loops.

24. The coiled tubing injector head of claim 22 in which each chain loop is mounted on an independent tractor assembly, the tractor assemblies being movable away from the injector head centerline, so allowing a larger diameter object to pass through the injector head.

* * * * *